US006338340B1

(12) United States Patent
Finch et al.

(10) Patent No.: US 6,338,340 B1
(45) Date of Patent: Jan. 15, 2002

(54) FILTER MASK

(75) Inventors: Peter Finch, Newport Beach; Eric Ellison, Orange, both of CA (US)

(73) Assignee: Xcaper Industries LLC, Newport Beach, CA (US)

( * ) Notice: Subject to any disclaimer, the term of this patent is extended or adjusted under 35 U.S.C. 154(b) by 0 days.

(21) Appl. No.: 09/432,674

(22) Filed: Nov. 2, 1999

(51) Int. Cl.[7] ..... A62B 7/10; A62B 23/02

(52) U.S. Cl. ..... 128/205.27; 128/205.29; 128/206.12; 128/206.15; 128/206.21; 128/206.24; 128/206.26; 128/206.28; 128/207.11; 128/207.12; 95/285; 55/522; 55/524

(58) Field of Search ..... 128/205.27, 205.29, 128/206.12, 206.15, 206.21, 206.24, 206.26, 206.28, 207.11, 207.12; 95/285; 55/522, 524

(56) References Cited

U.S. PATENT DOCUMENTS

| | | | | | |
|---|---|---|---|---|---|
| 695,403 | A | | 3/1902 | Longden | |
| 996,739 | A | | 7/1911 | Vinton | |
| 2,008,677 | A | | 7/1935 | Booharin | |
| 4,231,118 | A | | 11/1980 | Nakagawa | |
| 4,297,117 | A | | 10/1981 | Holter et al. | |
| 4,520,509 | A | | 6/1985 | Ward | |
| 4,572,178 | A | * | 2/1986 | Takase et al. | 128/205.27 |
| 4,573,217 | A | | 3/1986 | Reed | |
| 4,637,383 | A | | 1/1987 | Lopez | |
| 4,682,992 | A | * | 7/1987 | Fuchs | 55/279 |
| 4,683,880 | A | | 8/1987 | Werjefelt | |
| 4,688,567 | A | | 8/1987 | Kikuchi et al. | |
| 4,771,771 | A | | 9/1988 | Walther | |
| 4,854,314 | A | * | 8/1989 | Martin et al. | 128/205.27 |
| 4,870,959 | A | | 10/1989 | Reisman et al. | |
| 4,998,529 | A | | 3/1991 | Werjefelt | |
| 5,003,974 | A | | 4/1991 | Mou | |
| 5,035,006 | A | | 7/1991 | Hetz et al. | |
| 5,040,530 | A | | 8/1991 | Bauer et al. | |
| 5,058,211 | A | | 10/1991 | Hanks | |
| 5,119,808 | A | | 6/1992 | Marquardt et al. | |
| 5,140,980 | A | | 8/1992 | Haughey et al. | |
| 5,265,669 | A | | 11/1993 | Schneider | |
| 5,291,880 | A | | 3/1994 | Almovist et al. | |
| 5,315,987 | A | | 5/1994 | Swann | |
| 5,322,060 | A | | 6/1994 | Johnson | |
| 5,628,308 | A | | 5/1997 | Harges, Jr. et al. | |
| 5,690,101 | A | * | 11/1997 | Kutta | 128/205.27 |
| 6,082,360 | A | * | 7/2000 | Rudolph et al. | 128/206.25 |
| 6,085,748 | A | * | 7/2000 | Sword et al. | 128/206.23 |
| 6,119,692 | A | * | 9/2000 | Byram | 128/206.27 |

* cited by examiner

*Primary Examiner*—John G. Weiss
*Assistant Examiner*—Darwin P. Erezo
(74) *Attorney, Agent, or Firm*—Hovey, Williams, Timmons & Collins

(57) ABSTRACT

A filter mask is provided for use in environments of smoke and toxic gas which includes a filter element having a filling of shiftable bodies coated with a flowable, aloe vera extract having a gel-like viscosity and a retainer for holding the filter element over the mouth and nose of the wearer. The coating has a pH level which is alkaline which aids in the reduction of toxic gases such as hydrogen cyanide, hydrogen chloride and acrolein inhaled by the wearer. The filter element is preferably replacably mounted to the retainer, and may be provided as a bag-like flexible fabric container adapted to shift so as to conform to the face of the wearer. The filter element itself is adaptable to a variety of different uses for removing smoke particulates and toxic gases from air flowing therethrough.

22 Claims, 5 Drawing Sheets

FILTER MASK

BACKGROUND OF THE INVENTION

1. Field of the Invention

The present invention broadly concerns a mask which is to be worn in conditions of fire and smoke to filter harmful particulates and gases. More particularly, it is concerned with a mask which includes a lightweight and disposable filter element which includes a carrier element and a coating of aloe gel for removing smoke particulates and toxic gas during breathing to permit temporary work and escape.

2. Description of the Prior Art

The danger to persons attendant to fire has long been recognized to include death and injury attributable to smoke inhalation. In addition to injuries attributable to burns, one of the major causes of death and injury during fire is smoke inhalation. In many fire and smoke environments, there is sufficient oxygen available to permit escape, but the individual is overcome by smoke inhalation or toxic gas. Devices which are directed to filtering smoke particulates include U.S. Pat. Nos. 4,402,317 and 4,854,314. While the devices shown therein are useful in filtering smoke particulates during escape of occupants from a structure, they do not address the need for uses in other applications nor for the filtering of toxic gases such as hydrogen cyanide generated during building fires.

Firefighters also need temporary protection from smoke and fire. Firefighters, and especially those encountering brush fires and forest fires, may need to carry a substantial amount of equipment which may not include respirators. They may also suddenly encounter a dangerous situation such as the reversal of direction of a fire which may expose them to unexpected smoke and fire hazards. While masks have been developed for use in these environments, such as shown in U.S. Pat. No. 5,628,308, they have been uncomfortable to wear and expensive. Moreover, they have failed to address the need for a lightweight, temporary filter to remove toxic gas such as hydrogen cyanide from the air breathed by the wearer.

As a result, there has developed a need for a lightweight, easily storable filter mask which, in various constructions, can be stored in a home or office for emergency use, or used by firefighters or in industrial applications to augment available respirators.

SUMMARY OF THE INVENTION

The present invention satisfies the need for a lightweight, portable, and inexpensive mask capable of filtering both smoke particulates and hazardous chemicals which can be adapted to different needs. In its simplest form, the present invention includes a filter element and a retainer. The filter element has a container having a permeable fabric cover and a filling of shiftable bodies covered with a coating including a quantity of aloe vera gel. The retainer includes a support strap connected to the cover. Surprisingly, the coating primarily of aloe vera gel having an elevated pH as used in the present invention is not only non-toxic and gentle to the wearer if it contacts the skin, but traps smoke particulates and neutralizes toxic gases which would be harmful to the wearer. The aloe vera gel is preferably combined with a base to elevate the pH of the coating to an alkaline pH level of about 9.25 to 10. As a result, a high degree of neutralization of toxic gases such as hydrogen cyanide which come in contact with the aloe vera gel. The beads are preferably of a lightweight, non-absorbent material such as polystyrene of mixed sizes in the range of 0.01 inch to 0.5 inch in diameter. The simple filter mask described above may be worn to aid in the removal of smoke particulates and toxic gases during the escape of individuals from homes and other buildings in which smoke and fire is encountered.

In a second embodiment, the basic filter element, as described above without the strap, is provided as a disposable element within a retainer or mask. The filter element is removably attached to the inside of the facial portion of the mask to be in direct contact with and conform around the nose and mouth of the wearer, thus causing the inhaled air to be drawn therethrough and filtered. The facial portion of the retainer mask preferably has an outer, fire resistant fabric layer and includes a pocket for receiving the filter element therein, and straps for holding the facial portion in place. The retainer mask may also include a collar portion which is attached to a lower edge of the facial portion and hang downwardly therefrom to protect the neck and upper chest area of the wearer from heat and sparks. Additionally, the facial portion may be provided with an attachment member, such as a snap or hook and loop fastener, to connect to a firefighters goggles to provide additional resistance to slippage of the filter element away from the nose and mouth of the wearer.

In a third embodiment of the mask of the present invention, the filter element as described with reference to the second embodiment is attached to the inside of a retainer including shell which includes a substantially impermeable barrier except for at least one-way valve and an inlet for ensuring air entering the shell passes through the filter element. Straps are connected to the shell for holding it in place on the face of the wearer. The one-way valve is preferably an exhalation-only valve, with the filter element covering the inside of the inlet.

A fourth embodiment of the present invention is similar to the third embodiment, but wherein the filter element is provided as an external component to the mask. The filter element then preferably includes a rigid or semi-rigid container carrying the filling, which may be further augmented by carbon monoxide handling material. The bodies are covered with the modified aloe vera gel as described above either before insertion into the container or preferably thereafter, whereby the uncoated bodies may be stored in their containers until required for use. Mesh or other air-permeable screen-type material permits inhalation through the removable filter element, while a one-way valve permits exhalation. The filter element may be removed from a flexible gasket-type mount in the shell without the need for removing the mask. This may be helpful in some fire situations where removal of the mask would require removal of goggles or helmet and thereby expose the wearer to additional risks.

The resulting filter mask of any of the aforementioned embodiments presents significant improvements over the prior art. Further benefits will be readily appreciated by those skilled in the art with reference to the drawings and the written description of the preferred embodiments set forth below.

DESCRIPTION OF THE PREFERRED EMBODIMENT

Figure 1:
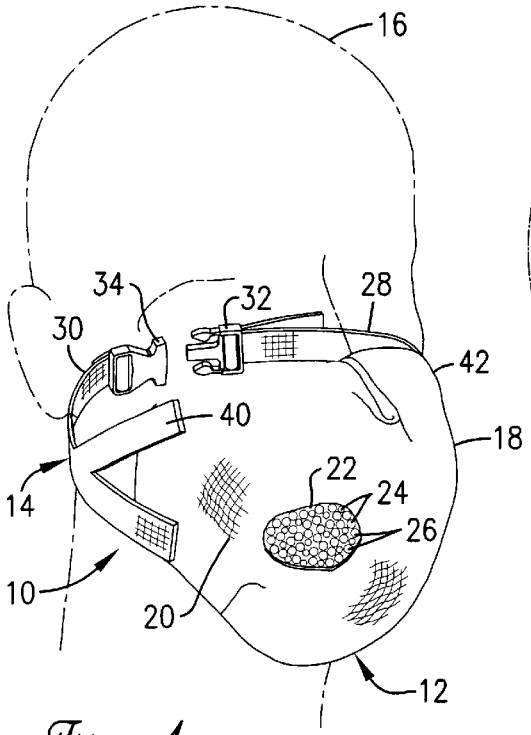
FIG. 1 is a front perspective view of a first embodiment of the filter mask of the present invention showing the a part of the cover broken away to show the coated beads therein, and straps for holding the cover in position over the nose and mouth of the wearer.

As shown in FIG. 1, the filter mask 10 of the present invention in its simplest form includes a filter element 12 and a retainer 14 for holding the filter element 12 in position over the nose and mouth of the wearer 16. The filter element 12 includes a container 18 having a cover 20 of flexible, air permeable material which is preferably soft and non-irritating to the skin of the wearer. Polyester is one such material which is suitable because of its non-absorbent properties. The cover 20 as shown in FIG. 1 is bag-like and preferably about 5 and ½ to 6 and ½ inches across, between about 4 and 6 inches vertically, and about ½ inch to 1 inch in thickness when laying flat to adequately cover the nose and mouth of a wearer. Of course, the cover could be of a greater dimension as desired to provide greater thickness or span across the face of the wearer. Preferably, to permit the use of small polystyrene beads therewithin and provide good breathability, the pores or interstices of the fabric cover are no more than about 1/64 inch.

The filter element 12 includes a filling 22 of lightweight, discrete, shiftable, substantially dust-free bodies 24 which are resistant to absorption of liquids. Such beads and suitable shape and size assortments thereof are shown, for example, in U.S. Pat. No. 4,854,314 to Martin, the disclosure of which is incorporated by reference. For the container size set forth above, a preferably quantity of bodies of polystyrene beads is approximately 164 to 173 grams. The beads are covered with a coating 26 derived from a flowable gel-like extract of the mucilaginous jelly from the parenchyma cells of the aloe vera plant referred to as aloe vera gel. Aloe vera is a succulent, fibrous plant, of the family Liliaceae, with basal leaves, having toothed or fibrous margins. The aloe vera gel is a well known emollient derived from the mucilaginous cells and is about 98.5% by weight water. More than 60% of the total solid is made up of polysacchiarides of carbohydrate origin. Organic acids and inorganic compounds, especially calcium oxalate, account for the remainder of the solid. Aloe vera gel ordinarily has a pH of about 4.5 to 5. The aloe vera gel is modified to improve its flowability in the present invention by adding moisture in the form of raw aloe vera extract or water to yield a viscosity of about 1.25 poise to 1.75 poise to provide suitable flowability, particulate capture, and retention of the gel on the bodies 24. The gel is then modified to increase the pH to an alkaline condition in order to neutralize toxic gases such as hydrogen cyanide, hydrogen chloride and acrilyne prior to inhalation through the filter element 12. The bodies 24 are preferably completely covered with the coating by immersion, massaging or other means such as spraying with the coating 26 after filling in the container, and typically between about ¼ and one ounce of coating material will be sufficient to thoroughly coat the bodies 24 in the amounts used in the filter elements 12 hereof. The amount of filling provided into the container 18 is sufficient to create a thickness of the bodies of about ¼ inch or more when in use, but will also permit some shifting of the beads within the container 18 in order that the filter element 12 is able to conform around the nose and mouth of the wearer.

The coating includes an extract from the aloe vera plant, a preservative, a base, and a modifier to maintain the desired viscosity and gel-like qualities of the coating. Aloe vera gel is particularly beneficial in the present invention because it is non-toxic, resistant to rapid loss of moisture, is soothing to the skin and effectively buffers the base, stores well, and provides good smoke particulate capture. Methyl paraben is a good preservative because it is non-toxic and helps resist the growth of mold. Sodium hydroxide is a satisfactory base, and sodium sesquicarbonate helps to maintain the viscosity and coating capability of the aloe vera and is slightly alkaline to help elevate or maintain the pH of the coating 26.

In accordance with a preferred embodiment of the invention, the coating 26 begins with aloe vera gel which is diluted, preferably by aloe vera juice but alternatively by water added to the aloe vera gel until the desired viscosity is achieved to yield a start-up mixture. Aloe vera gel is a commercially available product which is gel or jelly-like in consistency, while aloe vera juice is the liquid extracted directly from the leaf of the aloe vera plant and is liquid. The amount of aloe vera juice which may be added to the aloe vera gel may range between 20% and 50% of the aloe vera gel by volume, with 35% of the mixture being aloe vera juice being most preferred to provide the start-up mixture. One gallon of aloe vera start-up mixture is combined with five grams of methyl parabens (N.F.) and the resulting product is then stirred until thoroughly mixed. To this product, 75 grams of Carbapol 981 (N.F.) polymer is added and stirred until mixing is complete, typically for a period of 3–4 hours. Carbapol 981 is a carboxyvinyl polymer available from BF Goodrich Performance Materials of Cleveland, Ohio. This product is then mixed at slow speed in a Hobart 60 Quart power mixer with a sufficient quantity of 10% sodium hydroxide solution to raise the pH to 6.5 to 7.0. Thereafter a 10% solution of 10% sodium sesquicarbonate (50% sodium carbonate –50% sodium Bicarbonate) is added during mixing until the desired thickness and viscosity is achieved to provide coating for the bodies. The amount of sodium sesquicarbonate which is added will typically be up to about 0.22 pounds per gallon of the mixture. Additional 10% sodium hydroxide is added then added during mixing to bring the coating to a final desired pH level. The preferred pH level for the coating 26 is above 7.0, and most preferably in the range of 9.25 to 10. Optimal performance for the coating 26 is obtained with a pH of 9.80. The preferred viscosity is in excess of about 1.25 poise at 20° C. and the preferred kinematic viscosity of the coating 26 is between about SAE viscosity nos. 135 and 150.

As shown in FIG. 1, the retainer 14 includes a pair of elastic straps 28 and 30 provided respectively with a clasp 32 and receiver 34 at the distal ends 36 and 38 thereof. The proximal ends 40 and 42 of the straps 28 and 30 are stitched or otherwise secured to the filter element 12 so that upon placement of the filter element 12 over the nose and mouth of the wearer and securing the clasp 32 within the receiver 34, the filter element 12 will conform to the wearer's face and inhalation and exhalation will be through the filling 26 and cover 20.

FIGS. 2–6 illustrate a second embodiment 10A of the filter mask hereof. In the filter mask 10A, the filter element 12A is provided as a removable and disposable element for attachment within the retainer 14A so as to be positioned between the retainer 14A and the wearer 16. The retainer 14A includes a facial portion 50 which overlies the filter element 12A. Additionally, the filter mask 10A includes a collar 44 adapted to connect to the bottom of the retainer 14A and provide additional protection against heat and sparks.

In greater detail, the filter element 12A includes a container 46 a coupling member 48 for releasably connecting the container 46 to a facial portion 50 of the retainer 14A, and a filling 22 as described above. The container 46 is preferably a cover 52 of a polyester fabric material which is breathable through pores or interstices between the fibers which are desirably not more than about 1/64 inch in size. The container is preferably at least about 5 and ½ inch across, at least about 4 inches top to bottom, and at least about ½ inch in thickness when filled with the bodies 24. A typical filter element 12A will contain about 164 to 173 grams of the polystyrene bead bodies 24 as described herein above, which after securement within the flexible cover 52 are then coated with the coating 26. Coating may be accomplished by immersion of the container in a bath of the coating 26 and then allowing the excess coating to drip free, or by taking about one-quarter to about I ounce by volume of the coating 26 (for the weight of polystyrene bodies referenced above) and massaging it into the container 46 to coat the bodies 24. The coupling member 48 may be of hook and loop fabric as shown, but alternate couplers such as snaps, buttons, hook and eyelet, zippers or other conventional fastening means which permit ready detachment may be used. As shown, the hook fabric component 48' is sewn in three positions to the portion of the cover facing the facial portion 50 to maintain the filter element 12A in a spread position, properly located to cover the wearer's nose and mouth.

The facial portion 50 is preferably provided with an outer fire resistant layer 54 of Nomex® Defender 600 RS or other fire-resistant fabric on the normally outwardly facing surface 56, and a liner 58 sewn thereto of soft fabric material such as cotton or polyester on the normally inside surface 60. Polyester is especially beneficial as a lining material as it has been found to wick away moisture from the wearer's face. The facial portion includes an upper margin 62, a lower margin 64, and first and second flaps 66 and 68 terminating in respective first and second ends 70 and 72. As shown in FIGS. 2, 3 5 and 6, the flaps 66 and 68 extend sufficiently in length to permit wrapping around the neck of the wearer. The flaps are maintained in tension by elastic material such as Spandex® sewn between the layer 54 and the liner 58 to form gathers 74, and patches 76 and 78 of hook and loop fabric are sewn to the outwardly facing surface 56 of one flap and the normally inside surface 60 of the other flap adjacent the respective ends 70 and 72 to permit easy and adjustable fastening of the flaps 66 and 68, thereby holding the facial portion 50 in position. Reflective strips 80 such as, for example, 3M or G-SIL#9485 reflective tape, may be sewn or glued to the outwardly facing surface 56. Nomex® binding material may be used as an edge finish to resist raveling of the cloth.

A pocket 82 is formed in the facial portion 50 approximately midway between the ends 70 and 72 so as to be positioned over the wearer's mouth and nose and receive the filter element 12A therein. The loop fabric portion 48" of the coupling member 48 is sewn or glued to the inside surface 60 of the facial portion in complemental facing locations to the hook portion 48' to permit the filter element 12A to be removably mounted thereto. A central mesh portion provides a window 84 of breathable fire-retardant cloth such as Nomex® Hood Material is sewn over central opening 86 defined in the outer layer 54, which provides an air inlet so that inhaled air passes through the mesh portion 84 rather than through the outer fire resistant layer 54, and thus through the filter clement 12A. A connector 88 is provided to removably couple the collar 44 to the facial portion 50, the connector 88 being shown as hook material 90 positioned on the outwardly facing surface 56 adjacent the lower margin 64 in three locations 92, 94 and 96. Other suitable connectors 88 would include snaps, buttons, zippers, hooks and eyes, or other fasteners.

Figure 3:
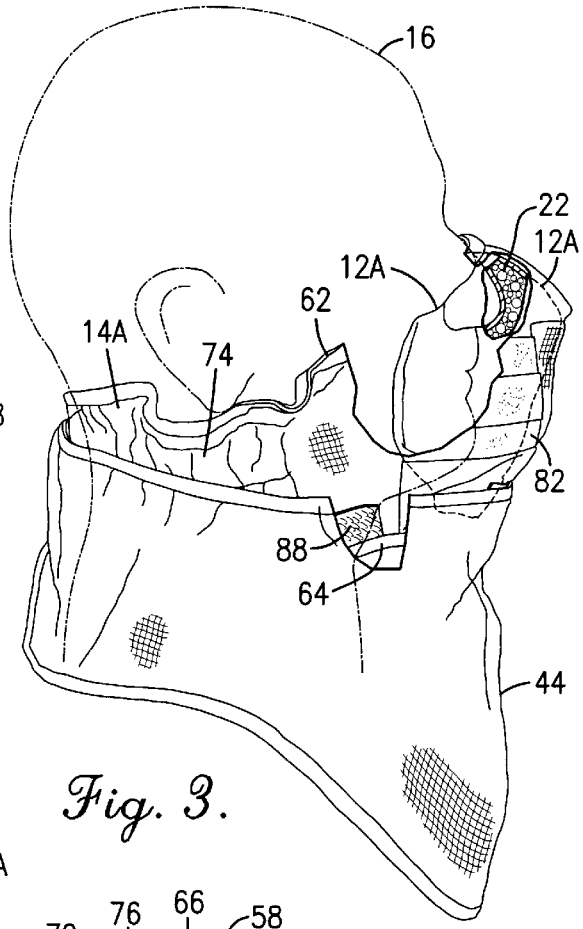
FIG. 3 is a left side elevational view of the filter mask shown in FIG. 2, with portions of the filter element, facial portion and collar portion broken away.
Figure 2:
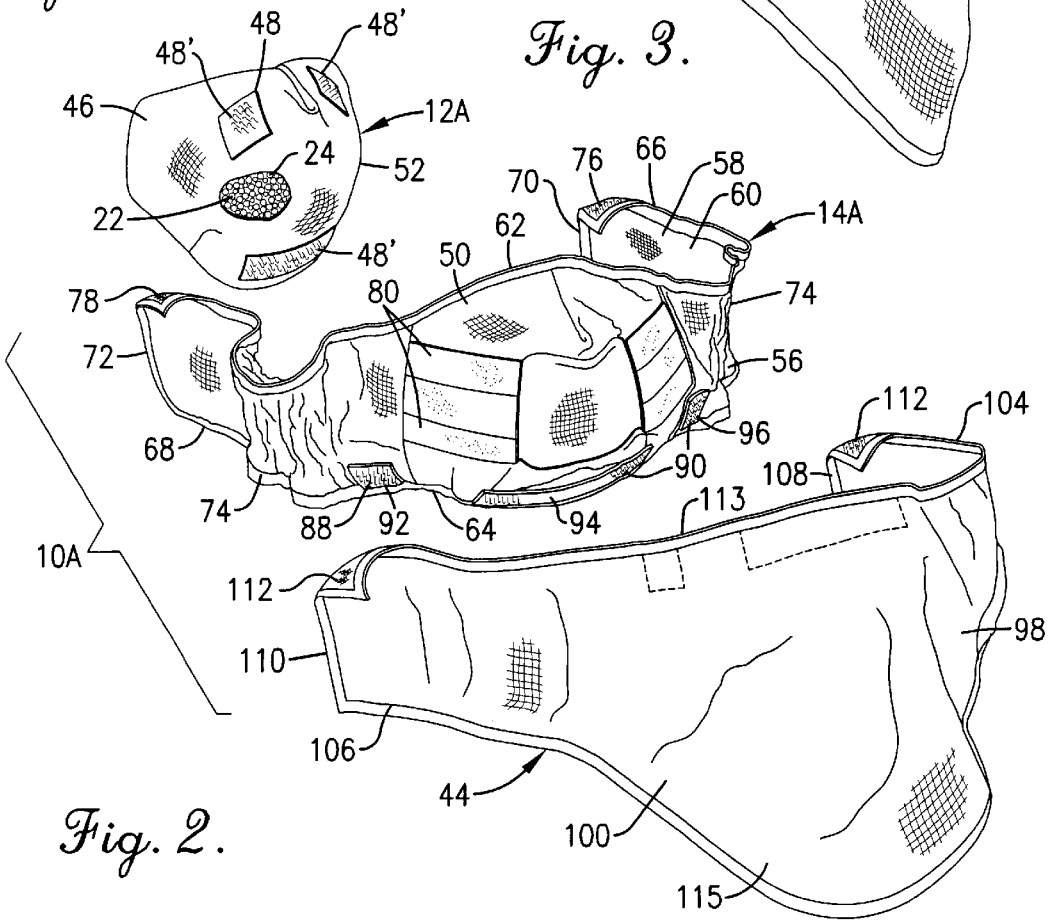
FIG. 2 is an exploded front perspective view of a second embodiment of the present invention for use by firefighters, showing the filter element, facial portion and collar portion.
Figure 4:
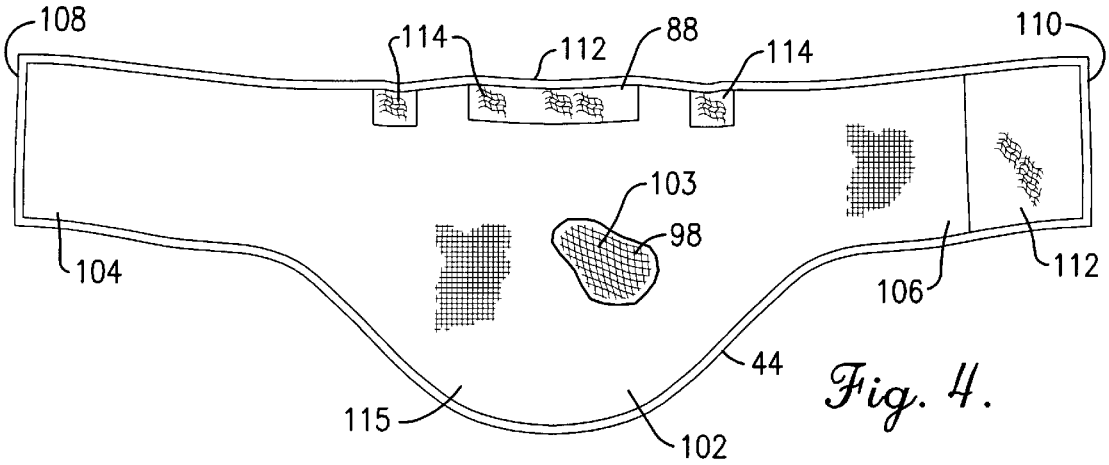
FIG. 4 is a rear elevational view of the collar portion of the filter mask of FIG. 2, with a portion of the lining material broken away to show the fire resistant outside layer.
Figure 5:
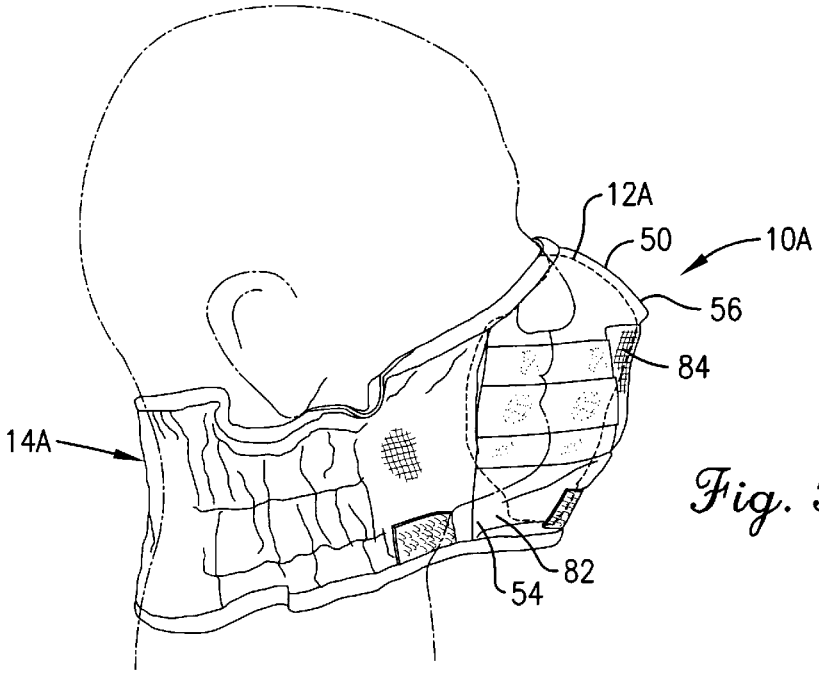
FIG. 5 is a left side elevational view of the facial portion of the filter mask of FIG. 2, with the filter element shown in phantom.
Figure 6:
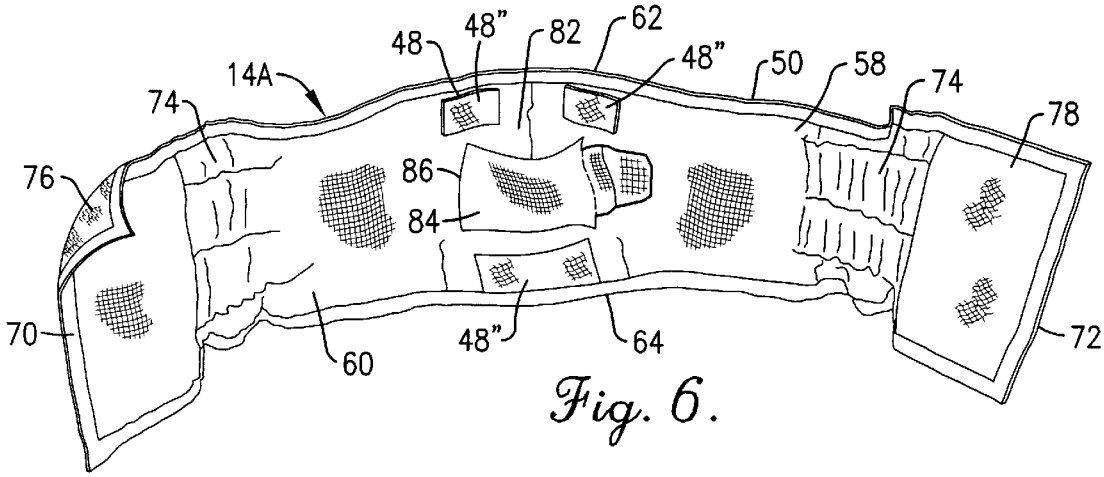
FIG. 6 is a rear perspective view of the facial portion of the filter mask of FIG. 2, with the filter element removed to show the pocket and attachment members into which the filter element is received.

The collar 44 shown in FIGS. 2, 3 and 4 includes an facing layer 98 of Nomex® Defender 600 RS or other fire-resistant material on an outer surface 100 and an inner layer 102 of a soft cloth material such a cotton or polyester backing on an inner surface 103. Two arms 104 and 106 extend normally rearwardly around the back of the neck of the wearer, each ending in a respective tail 108, 110. A closure 112 of hook and loop fabric material is provided and sewn to the outer surface 100 of one arm and the inner surface 103 of the other arm adjacent the respective tails 108, 110 to retain the collar around the neck of the wearer. Nomex® binding material may be sewn around the perimeter of the collar 44 to prevent raveling. A clip or length of binding material may be sewn to one or both of the tails to aid a firefighter in retaining the collar 44 on a tool belt when not in use. The collar has an upper edge 113, with the loop material 114 of the connector 88 being sewn or glued in three complemental locations on the outer surface 100 adjacent the upper edge 113, whereby the collar 44 may hang from the lower margin of the facial portion 50. An enlarged bib 115 is located midway between the tails 108, 110 to provide enhanced protection in the frontal region over the wearer's chin, throat and upper chest.

Figure 7:
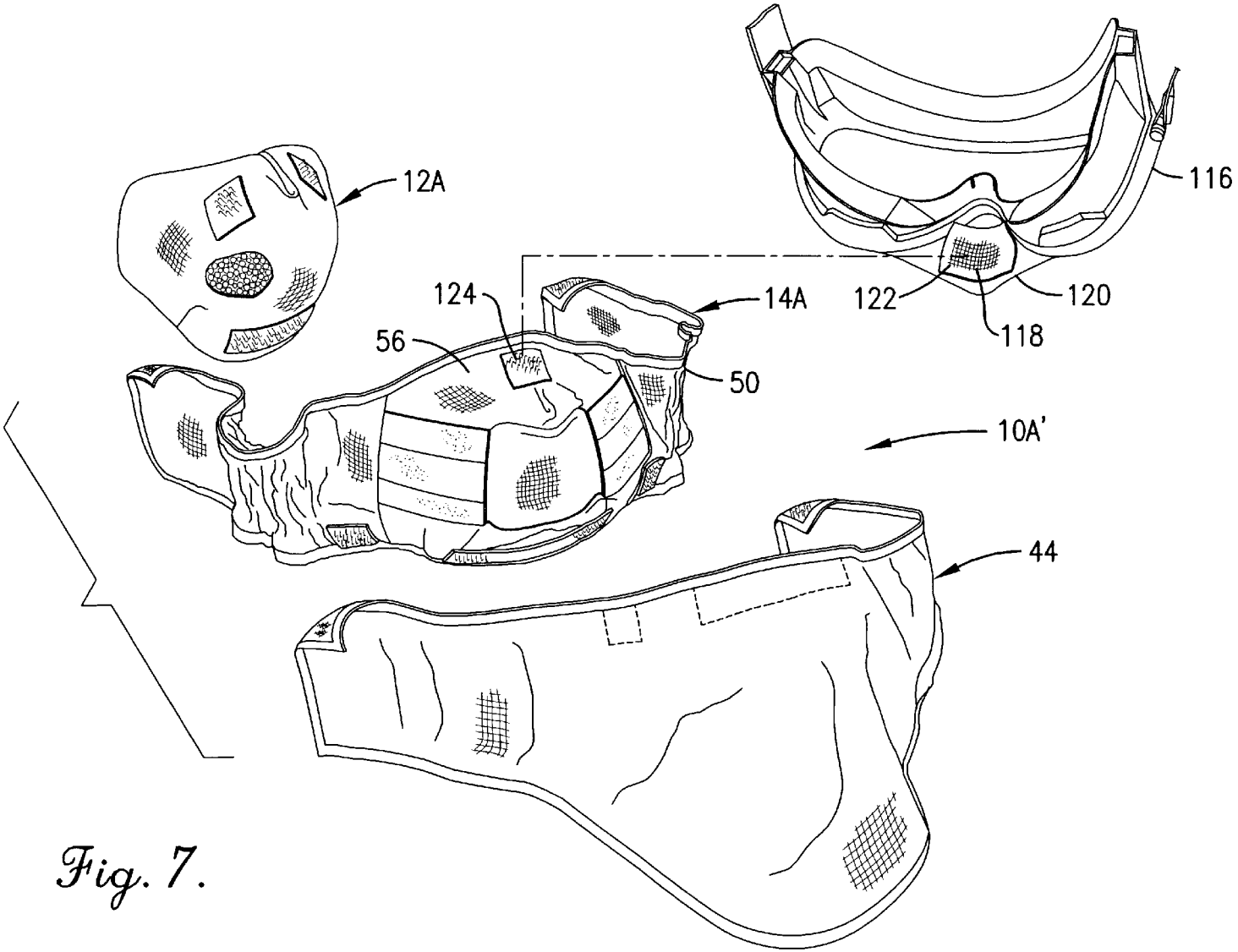
FIG. 7 is an exploded view of a modified form of the embodiment of FIG. 2, showing a firefighters goggles and a releasable fastener for connecting the facial portion of the mask to the goggles.
Figure 8:
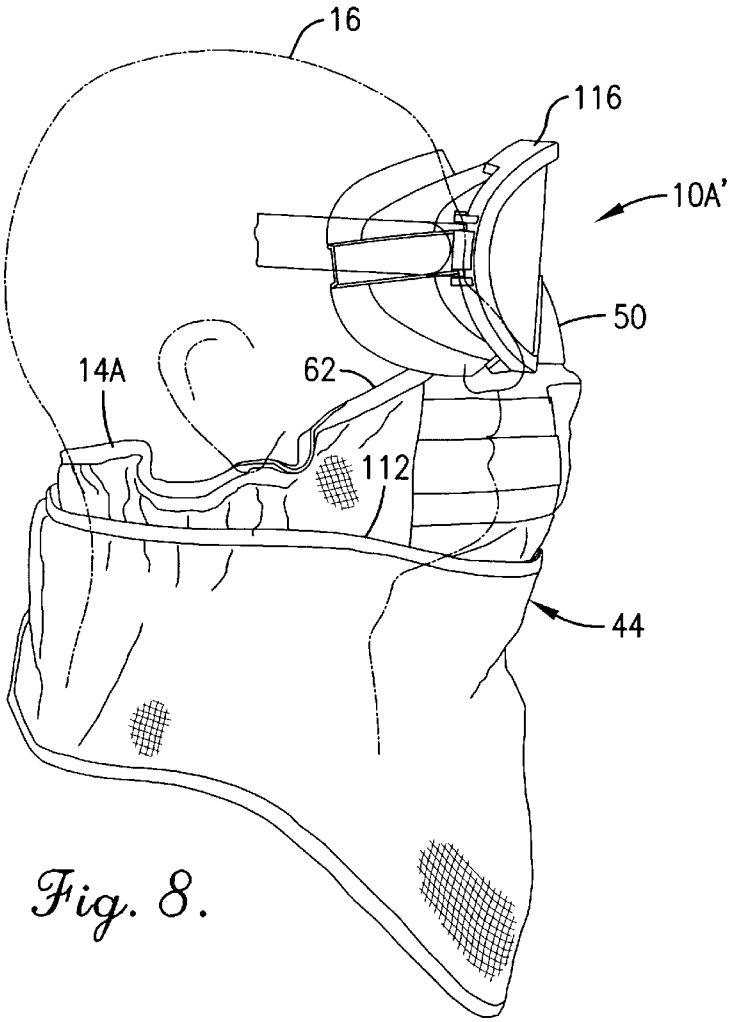
FIG. 8 is a side elevational view of the embodiment of FIG. 7, with the goggles and filter mask in place on the face of a wearer.

A modification of filter mask 10A' is shown in FIGS. 7 and 8. The filter mask 10A' is in all respects similar to filter mask 10A, except that it is especially adapted to include goggles 116 in combination therewith. To that end, a coupler 118 is provided to connect the goggles 116 to the facial portion 50 adjacent the upper margin 62 thereof. As shown in FIGS. 7 and 8, the goggles 116 include a nose bridge portion 120 and the coupler 118 includes a loop fabric portion 122 glued or otherwise secured to the inner side of the nose bridge portion 120, while a complemental hook fabric portion 124 is sewn or glued to the outwardly facing surface 56 adjacent the upper margin 62. The goggles 116 thereby aid in holding the upper margin 62 over the nose of the wearer 16 to both support the filter mask 10A' in position but also to provide greater resistance to burns over the nose region.

Figure 9:
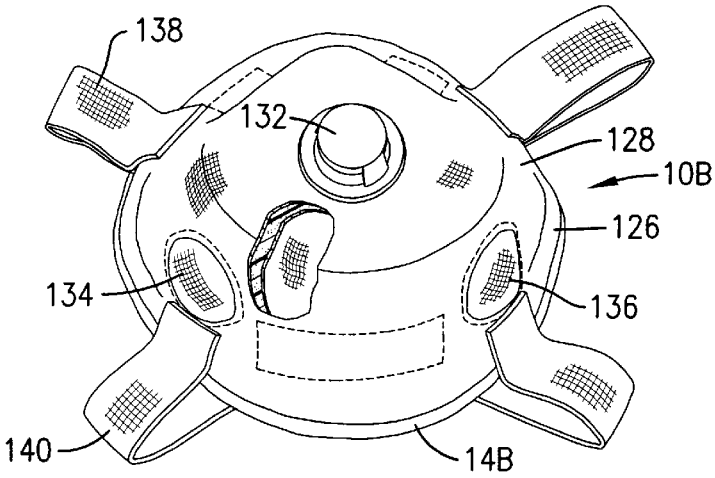
FIG. 9 is a lower front perspective view of a third embodiment of the filter mask of the present invention, showing the cover with the one-way exhalation valve and straps for holding the mask in position.
Figure 10:
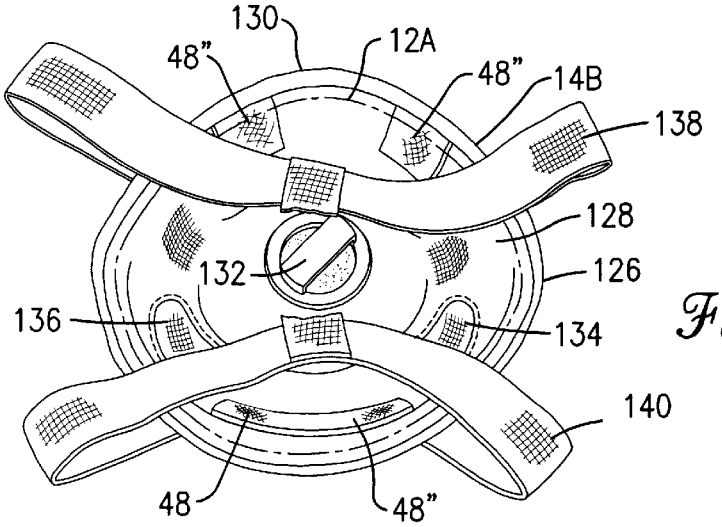
FIG. 10 is a lower rear perspective view of the filter mask of FIG. 9, showing the rear of the one-way valve, with the filter element shown in phantom.

A further embodiment of the filter mask 10B is shown in FIGS. 9 and 10. Filter mask 10B utilizes the same filter element 12A as referenced above. However, the retainer 14B has a facial portion 126 which is provided as a semi-conical shell 128. The shell 128 is provided of substantially impermeable foam, such as, for example, 1.2 lb. density ⅝ inch thickness polyurethane foam. The shell is sized to substantially cover the cheeks, nose and chin of the wearer 16 but to have an upper margin 130 which is below the eye sockets to permit vision. A one-way check valve 132 is centrally located, the check valve 132 oriented for permitting exhalation but not inhalation therethrough. Two polyester or Nomex® cloth filter screens 134 and 136 are secured by gluing or sewing on the inside of openings in the shell 128 and located so that during inhalation, the air is drawn through the filter element 12A, shown in phantom in FIG. 10, before entering either the wearer's nose or mouth. Elastic straps 138 and 140 are sewn or otherwise affixed to the exterior side of the shell 128 so as to be located for extending around the back of the wearer's head and tensioning the shell adjacent the wearer's face. Coupling member 48 also includes the loop fabric 48" on positioned on the interior side of the shell 128 for holding the filter element 12A in proper position. The filter mask 10B is designed to provide egress from an indoor fire where adequate oxygen is present.

Figure 11:
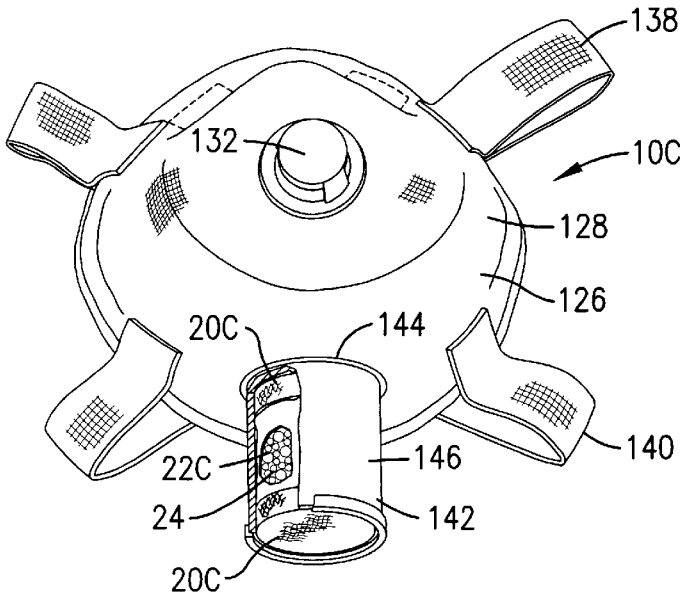
FIG. 11 is a lower rear perspective view of a fourth embodiment of the filter mask of the present invention, similar to the filter mask of FIG. 9 except that an exterior filter cannister is provided instead of the removable filter element.

A fourth embodiment of the filter mask 10C is shown in FIG. 11. It is similar to the embodiment shown in FIGS. 9 and 10, except that the filter element 12B is provided with a container in the form of an externally mounted cannister 142, and the screens 134 and 136 are replaced by a mounting gasket 144 of rubber or synthetic rubber such as Neoprene which elastically grips the cannister 142. The cannister is provided with a modified filling 22C which includes the coated bodies 24 of polystyrene as described above occupying about 50% to 90% of the volume therein, with the remaining volume of the cannister 142 being provided of Carulite particles by Carus Chemical of Peru, Ill. A typical amount of Carulite used in the cannister 142 is about 70 grams, the Carulite being used to capture carbon monoxide passing therethrough. Polyester woven covers 20C are positioned at each end of the cannister, which has a cylindrical wall 146 of aluminum. Aluminum or other moisture barrier caps may be provided over each cover 20C during storage and until the time for use. Air is inhaled by the user through the cannister 142 and exhaled through the one-way check valve 132. This filter mask 10C provides additional capture of carbon monoxide gases.

Figure 12:
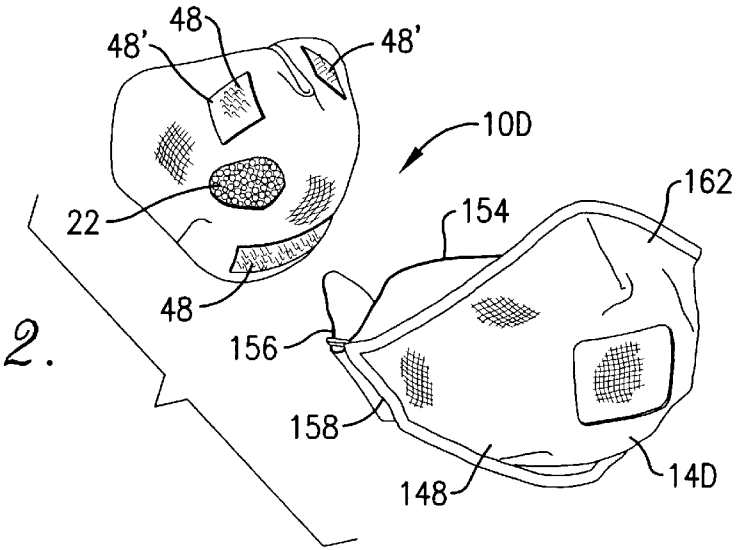
FIG. 12 is an exploded front perspective view of a fifth embodiment of the present invention, showing the filter element of the embodiment of FIGS. 2 through 10 held by a facial protector.
Figure 13:
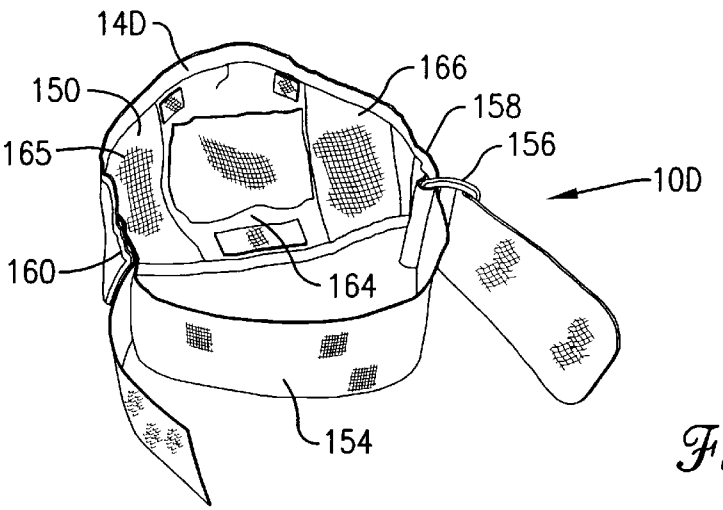
FIG. 13 is a rear perspective view of the facial protector of FIG. 12.

A fifth embodiment of the filter mask 10D is shown in FIGS. 12 and 13. The filter element 12A is as described herein above, with a modified retainer 14D. The retainer 14D includes an outer fabric layer 148 of fire-resistant material such as Nomex® Defender 600 RS and having an inner side 150 and an outer side 152. The inner side is provided with loop fabric 48" of coupling member 48 for attachment of the filter element 12A thereto. The retainer 14D further includes an elastic strap 154 connected by metal loops adjacent the side edges 158 and 160 of the facial portion 162. The facial portion of the retainer 14D further forms a pocket 164 for receiving the filter element against the wearers face as described above. The inner side 150 also includes side flaps 165 and 166 which aid in restraining the filter element 12A against excessive lateral shifting within the pocket 164. This version of the filter mask 10D is useful for firefighters experiencing only limited close contact with the fire environment.

Surprisingly, the use of the coating 26 on the bodies 24 provides excellent short-term removal of not only smoke particulates of at least about 90%, but also toxic gases, e.g. hydrogen cyanide removal of at least about 80%. Testing under situations approximating the normal breathing flow of a human (approximately 22 liters per minute) revealed that uses of the filter element 12A resulted in a reduction of hydrogen cyanide gas from about 365 parts per million to about 23 parts per million. Similar testing revealed a capture of about 94.7% of hydrogen chloride passing through the filter element 12A and a capture of about 99.1% of acrolein. The filter element also retains an excellent ability to capture smoke particulates, with a reduction from 90 to 95% of the smoke particulates passing therethrough. The ability of the aloe vera based coating resists irritation to the wearer's face while maintaining an alkaline pH, with a pH between 9.25 and 10 being especially beneficial for treating toxic gases while remaining non-irritating to the wearer's skin. In addition, the aloe vera based coating resists drying to maintain the ability to capture smoke particulates and capture toxic gases over a period of up to eight hours, depending on the severity of the smoke particulates and gases. Beneficially, the filter elements are easily replaceable, lightweight, may be stored in sealed bags for extended periods without degradation, are non-toxic, and require no special training prior to use. The filter masks hereof may be used in any temperature within the limits of survival.

Although preferred forms of the invention have been described above, it is to be recognized that such disclosure is by way of illustration only, and should not be utilized in a limiting sense in interpreting the scope of the present invention. Obvious modifications to the exemplary embodiments, as herein above set forth, could be readily made by those skilled in the art without departing from the spirit of the present invention.

The inventors hereby states their intent to rely on the doctrine of equivalents to determine and assess the reasonably fair scope of their invention as pertains to any apparatus not materially departing from but outside the literal scope of the invention as set out in the following claims.

What is claimed is:

1. A filter mask, comprising:

a filter element, including a container, at least a portion of the container including a cover of air permeable fabric, a filling material of loose, discrete, individually shiftable bodies received in said container, and a coating applied to said bodies, said coating having a composition which includes a quantity of aloe vera gel and having a pH greater than 7.0; and a retainer for holding said filter element in fluidic communication with the nose or mouth of a person wearing the mask.

2. A filter mask as set forth in claim 1, wherein said bodies are polystyrene beads having a diameter of between about 0.01 inch to about 0.50 inch.

3. A filter mask as set forth in claim 1, wherein said coating has a pH of about 9.25 to about 10.

4. A filter mask as set forth in claim 1, wherein said coating is spreadable and includes a quantity of aloe vera gel diluted with aloe vera juice.

5. A filter mask as set forth in claim 4, wherein said coating further includes an alkaline compound selected from the group of sodium hydroxide, sodium carbonate, sodium bicarbonate and sodium sesquicarbonate.

6. A filter mask as set forth in claim 1, wherein said retainer for holding the filter element comprises at least one strap configured for extending around the back of the head of a wearer and a facial portion connected to said strap and overlying at least the mouth and nose of the wearer.

7. A filter mask as set forth in claim 6, wherein said facial portion is configured to present a pocket oriented toward the nose and mouth of the wearer for receiving said filter element therein with said filter element positioned between the wearer's face and the facial portion.

8. A filter mask as set forth in claim 7, including a releasable coupling for interconnecting the filter element to said facial portion.

9. A filter mask as set forth in claim 8, wherein said coupling includes hook and loop fabric.

10. A filter mask as set forth in claim 6, wherein said facial portion includes a window defining an air inlet, with said filter element positioned in covering relationship interior to said window.

11. A filter mask as set forth in claim 10, wherein said facial portion surrounding said window is substantially impermeable to air.

12. A filter mask as set forth in claim 11, including a one-way exhalation valve in said facial portion for the passage of exhaled air therethrough.

13. A filter mask as set forth in claim 6, wherein said facial portion includes a shell having a one-way exhalation valve and a mount for removably receiving thereon said filter element remotely to, but in fluidic communication with the wearer's face, and whereby the filter element may be replaced without removing the facial portion from engagement with the wearer.

14. A filter mask as set forth in claim 13, wherein said cover of said filter element includes a substantially rigid wall portion and air permeable fabric portions for retaining the bodies within the cover but permitting the passage of air therethrough.

15. A filter mask as set forth in claim 6, wherein said facial portion includes at least an outermost fire retardant fabric material.

16. A filter mask as set forth in claim 15, wherein said facial portion includes an inner liner of substantially non-abrasive fabric selected from the group of cotton and polyester.

17. A filter mask as set forth in claim 15, wherein said facial portion presents a normally upper margin and a normally lower margin, said filter mask further including a collar portion having an upper edge, and further including connecting means for releasably connecting said upper edge of said collar to said lower margin of said facial portion.

18. A filter mask as set forth in claim 17 including goggles, and including a coupler for releasably connecting the goggles to the upper margin of the facial portion.

19. A filter mask as set forth in claim 18, wherein said coupler is provided of hook material mounted adjacent the upper margin of the facial portion and loop material mounted to the goggles.

20. A filter mask as set forth in claim 1, wherein said filter element removes at least 80% of hydrogen cyanide gas passing therethrough at normal breathing rates.

21. A filter mask according to claim 20, wherein said filter element further removes at least about 90% of smoke particulates passing therethrough at normal breathing rates.

22. A filter element for removing particles from air comprising:

a container, at least a portion of which is air permeable;

a plurality of discrete bodies received in said container; and a coating applied to said bodies, said coating having a composition which includes a quantity of aloe vera gel and having a pH greater than 7.0.

* * * * *